US005885523A

United States Patent [19]

Lohmüller et al.

[11] Patent Number: 5,885,523

[45] Date of Patent: Mar. 23, 1999

[54] DEVICE FOR CONTINUOUSLY ANNEALING CONTINUOUSLY FORMED METALLIC GOODS

[75] Inventors: Bernt Lohmüller, Rednitzhembach; Dieter Ferschl, Schwabach, both of Germany

[73] Assignee: Maschinenfabrik Niehoff GmbH & Co. KG, Schwabach, Germany

[21] Appl. No.: 838,681

[22] Filed: Apr. 9, 1997

[30] Foreign Application Priority Data

Apr. 12, 1996 [DE] Germany ..... 196 14 586.4

[51] Int. Cl.[6] ..... C21D 9/62

[52] U.S. Cl. ..... 266/104; 266/111; 219/155

[58] Field of Search ..... 266/102, 103, 266/104, 110, 111, 112; 148/566, 526; 219/155

[56] References Cited

U.S. PATENT DOCUMENTS 3,830,478 8/1974 Pietroni ..... 266/104
4,116,433 9/1978 Vogel ..... 266/104

FOREIGN PATENT DOCUMENTS 40 10 309 C1 5/1991 Germany .

*Primary Examiner*—Sikyin Ip
*Attorney, Agent, or Firm*—Pearne, Gordon, McCoy & Granger LLP

[57] ABSTRACT

A device for continuously heat-treating continuously cast or formed metallic goods, particularly wire and the like. The device comprises a first annealing path in which the continuously formed metallic goods are guided by means of two contact rollers. The first and second contact rollers are arranged at first and second ends, respectively, of the first annealing path. Moreover, the first and second contact rollers are connected to a voltage source such that a current flows through the continuously formed metallic goods between the first and second contact rollers. The device further comprises a second annealing path similar to the first annealing path. The device further comprises a third annealing path in which the continuously formed metallic goods are guided by means of two contact rollers, the fifth and sixth contact rollers are arranged at first and second ends, respectively, of the third annealing path, and wherein a switching means is further provided by which the fifth and sixth contact rollers may be connected to a voltage source such that a current flows through the third annealing path, if the switching means is in a first switching position and such that no current flows through the third annealing path, if the switching means is in a second switching position.

14 Claims, 4 Drawing Sheets

DEVICE FOR CONTINUOUSLY ANNEALING CONTINUOUSLY FORMED METALLIC GOODS

The present invention relates to a device and a method for continuously annealing continuously formed metallic goods, such as wire, wire bundles consisting of a plurality of single wires and the like.

When processing metals in cold state, usually significant changes in the structure of the metallic structure result, whereby important properties of the metallic material, such as strength, ultimate stress limit etc. may be adversely changed. Therefore, after processing, metals are usually subjected to an annealing treatment in order to recrystallize the structure.

A particular problem arises in the heat treatment of goods to be continuously processed, i.e. more specifically for wires and the like. In this case, only a relatively short period of time is available for introducing heat into the metallic goods. The technical problems involved in such production apparatus will be described in the following, using an annealing device for wires made of non-noble metals, particularly copper wires, as an example. The description, however, is neither intended as limitation of the applicability of the device and the method for materials made of other metals nor of the type of the continuously formed material as a whole.

In DE 40 10 309 C1, a device for annealing metal wires, particularly copper wires, is disclosed. The wire coming out of the actual production apparatus, namely the wire drawer, passes plural electric contact rollers in an annealing device, in the shown embodiment four rollers, which supply current to said wire. The current flowing between the metal rollers causes a heating of the wire and a desired modification of the structure, if the temperature conditions have been appropriately chosen.

In this known apparatus, three annealing paths connected in series are used, requiring four contact rollers for making contact to said wire. The known annealing device is supplied with DC current, and a regulating device is provided for regulating the voltage dependent on the passing velocity of the wire such that the power supplied to the wire per length unit is essentially constant.

In annealing devices having three annealing paths, the first annealing path usually is a pre-annealing path, and the second annealing path is a main annealing path in which said wire is heated to the required annealing temperature. Said main annealing path may be arranged in an inert gas atmosphere so as to prevent the wire from being oxidized. Following the main annealing path, the wire is cooled with water and thereafter in the third annealing path, i.e. the after-annealing path, is reheated again so as to remove the water and to dry the wire.

Starting from this prior art, it is an object of the present invention to provide a device and a method for continuously annealing continuously formed metallic goods wherein the power supplied to said continuously formed metallic goods is minimum.

This object is achieved by the device and method of the present invention. Preferred embodiments of the invention are set forth herein.

The present invention is based on the idea that the division of the heat supply into three annealing paths in many applications effects an energy consumption which is too high. In the usual three-path annealing device, the first path is a pre-annealing path, the second path is a main annealing path and the third path is the after-annealing path which is used to remove the water adhering to the wire after cooling.

The circumferential area of a cylindric piece of wire increases in proportion to its radius, while its volume increases with the square of its radius. An increase of the wire diameter by a factor of two therefore effects an increase of the circumferential area of the wire by a factor of two and an increase of the wire volume by a factor of four. Therefore, in thick wires more heat is stored in the wire itself, making unnecessary an after-annealing, which is exclusively intended for drying the outer diameter of the wire. Moreover, the drying process of the wire after cooling depends on the velocity of the wire passing said annealing device. For a high velocity of the wire, the time available for drying is decreased which results in the fact that an after-annealing is rather required for a higher velocity of the wire than for a lower velocity of the wire.

The inventive device and method enable the adaption of the number of the annealing paths to the actually prevailing conditions. In a thicker wire usually requiring only two annealing paths, a switching means is operated such that only two annealing paths are available. For a thinner wire diameter, the third path is added, which resulus in the desired after-annealing.

Experiments have yielded the result that the present invention results in energy savings amounting to 20 to 30% in comparison to the three-path operation. Considering the large amounts of wire which are produced in modern production apparatus being operated in three-shift organization, the energy savings amounting to 20 to 30% in said annealing device present a very valuable advantage over the usual apparatus.

Moreover, the invention provides the possibility to extend the production program of existing apparatus to diameter ranges which up to now could not be produced or could not be reasonably produced, e.g. by supplementing existing apparatus or even novel apparatus.

According to a preferred embodiment of the invention, the first contact roller is connected to a first potential, i.e. in the usually adopted DC voltage at the minus or the plus pole, and the second contact roller which is arranged at the end of the first annealing path is connected to the opposite second potential. Preferably, this second contact roller is identical to the third contact roller which is located at the beginning of the second annealing path and which in turn exhibits an potential opposite to that of the third contact roller which is located at the end of the second annealing path.

Preferably, this third contact roller constitutes the beginning of the third annealing path which is terminated by a fourth contact roller.

According to a specifically preferred embodiment of the invention, the addition of the after-annealing path is effected by separating the first contact roller from said first potential, i.e. when using DC voltage from the plus or minus pole, and by electrically connecting it to the fourth contact roller.

In this case, a current flow from the second contact roller to the third contact roller results, i.e. from the beginning to the end of the main annealing path, and a current flow leading from the third contact roller via the fourth contact roller, the connection path to the first contact roller and further via the wire again to the second contact roller. From the electrical point of view, the after-annealing path and the pre-annealing path are connected in series, and both paths are connected in parallel to said main annealing path.

This construction exhibits the advantage that no additional regulating means is required. The switching over from the two-path operation to the three-path operation and reversely may be effected by simply switching over a switch which on one side interrupts the connection of the first contact roller to the voltage source and, on the other side, connects the first contact roller to the fourth contact roller.

Other advantages, features and application possibilities of the present invention will become readily apparent from the following description of an embodiment with respect to the accompanying drawings, wherein.

A first embodiment of the present invention will now be described with respect to FIG. 1 and 2.

Figure 1:
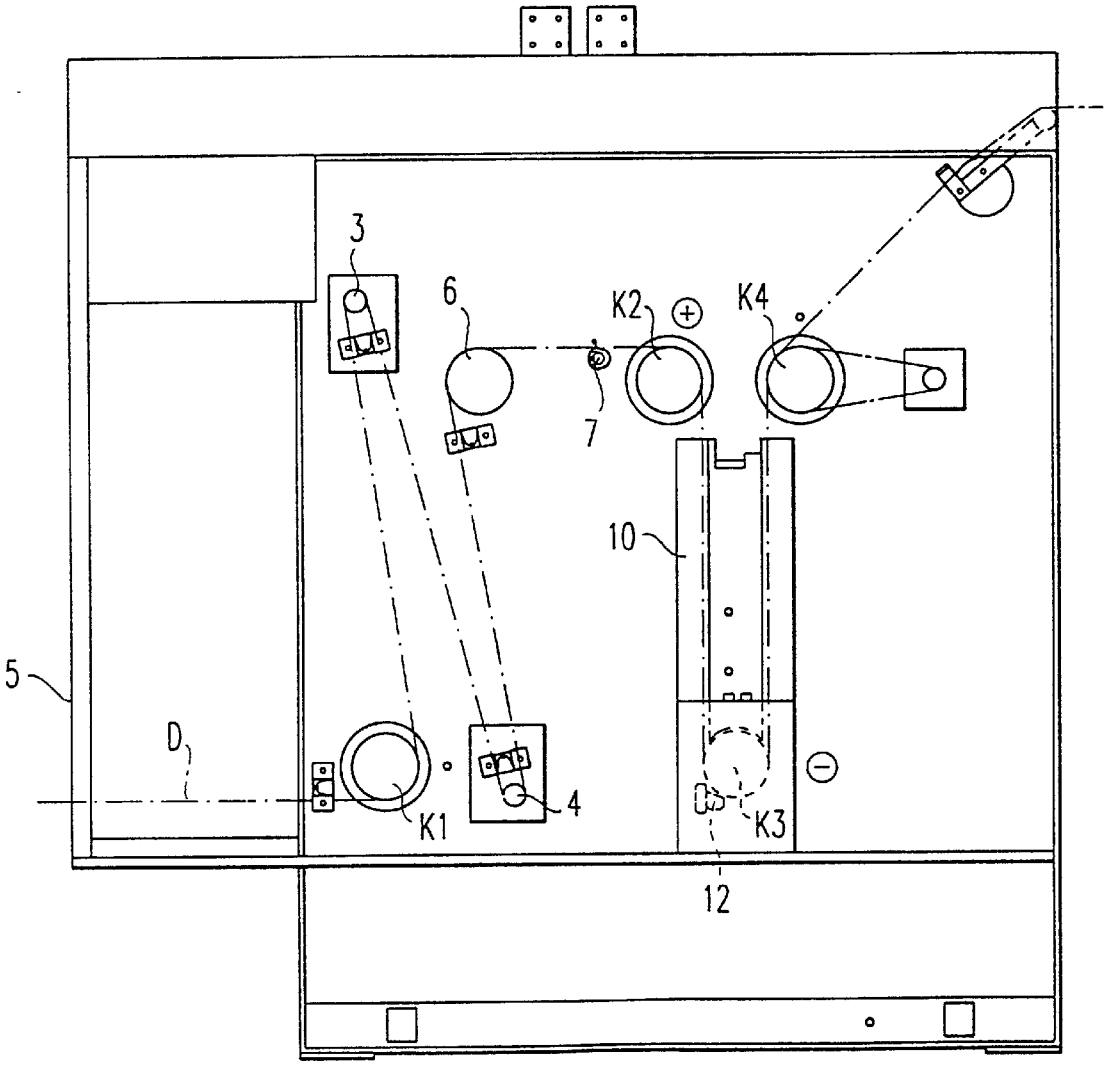
FIG. 1 shows a schematic illustration of the front view of an annealing apparatus according to an embodiment of the present invention.

FIG. 1 shows a schematic front view of an annealing apparatus for copper wire, wherein the wire D enters in the left part of the Figure and is guided by a contact roller K1.

From said contact roller K1, the wire runs over a deviating roller 3 and further to a deviating roller 4 adjacent to said contact roller K1. The wire further advances via another deviating roller 6 and a comb roller 7 for reciprocating said wire in a direction which is perpendicular to the plane of the drawing of FIG. 1 so as to prevent a wear of the following contact roller K2. The position of the deviating rollers may be adjustable for changing the length of the wire between the contact rollers K1 and K2.

From the contact roller K2 being connected to the plus pole, the wire advances into the main annealing path 10, wherein an inert gas atmosphere is provided for preventing said wire from becoming oxidized. In the present embodiment, the inert gas atmosphere consists of water steam, however, instead also another usual inert gas may be used.

In said main annealing device 10, the wire is deviated via a contact roller K3. Preceding the contact roller K3, a water spraying means 12 is provided for cooling said wire.

The contact roller K3 is connected to the minus pole of the current supply. The wire further advances via the contact roller K4 and thereafter leaves the annealing apparatus.

Figure 2:
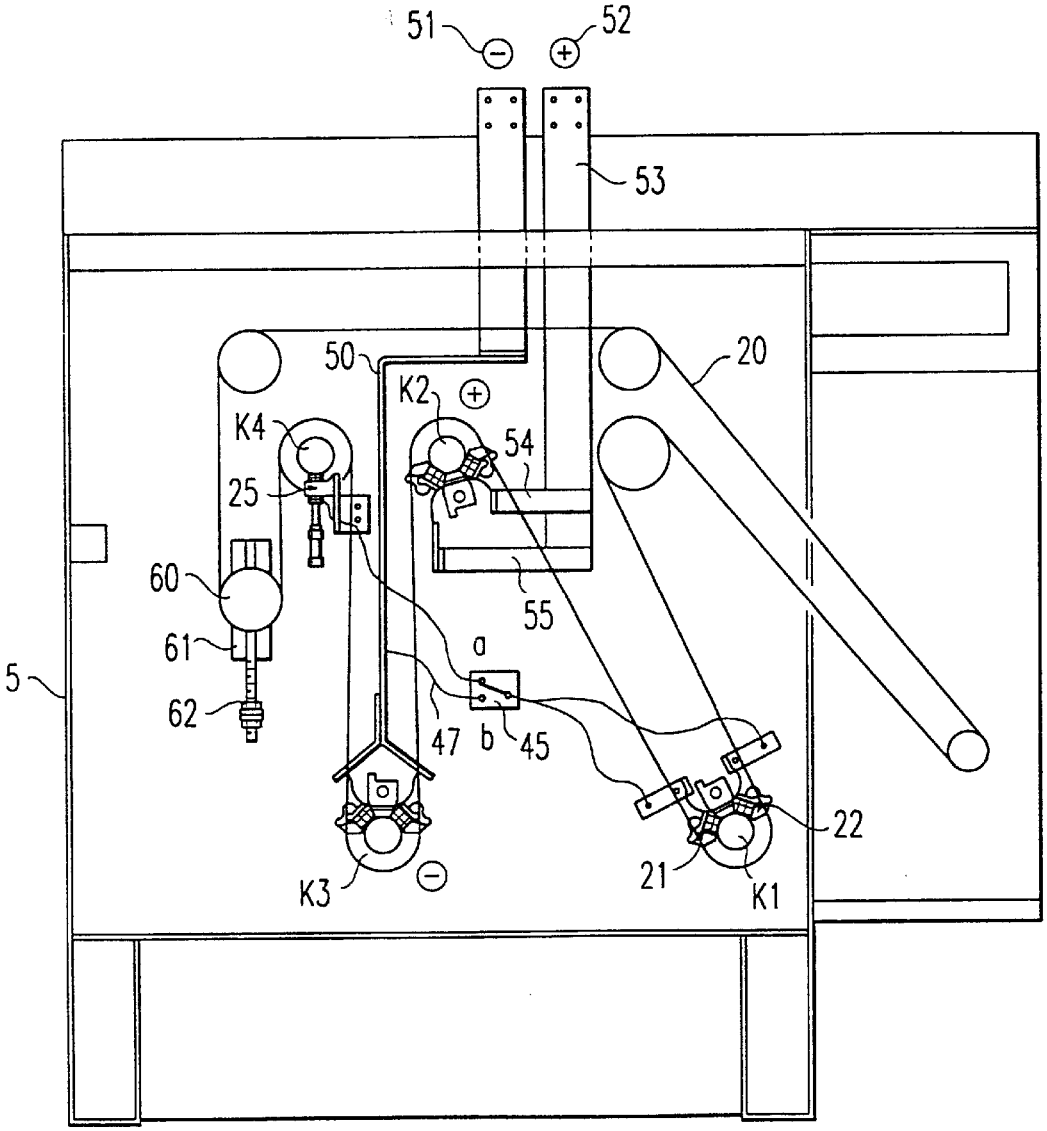
FIG. 2 shows a rear view of the apparatus of FIG. 1.

FIG. 2 shows a rear view of the annealing apparatus of FIG. 1.

The contact rollers K1, K3, K2 and K4 are connected to each other by means of a belt 20, which effects that the contact and deviating rollers are synchronously moving with respect to each other, as may be seen in this Figure.

The contact rollers K1, K2 and K3 are electrically contacted by carbons 21 and 22, respectively. The structure of this carbons or brushes is well known in the state of the art and therefore a further description will be omitted.

In the contact roller K4, an additionally connectable carbon brush 25 is provided, the construction and function of which will be explained with respect to FIG. 3 in the following.

The contact roller K4 is concentrically connected to a belt disc 30, by which said belt 20 is guided for driving the individual contact rollers. Concentrically with respect to said belt disc, a sliding ring disc 32 is provided being in contact with a carbon brush 33. This carbon brush exhibits such dimensions that the required current may be transmitted to said contact roller. The carbon brush is guided in a supporting means 34, which is rigidly connected to the housing 5 of said annealing apparatus, however electrically isolated to the latter.

At the distal end of the carbon brush 33 with respect to the sliding ring 32, the piston 36 of a pneumatic piston-cylinder means 37 is engaged. The piston-cylinder means is electrically isolated attached to said housing 5 by means of a supporting means 38. The control of the piston-cylinder means 37 is effected by means of a two-path solenoid valve 40.

The current supply of the carbon brush is effected by means of two cables 41, 42 attached to the supporting means 34. Additionally, a flexible cable 44 is provided for electrically conductively connecting said supporting means and said carbon brush with each other.

Also the supporting means 34 and the current supply are electrically isolated with respect to said housing 5.

As may be obtained from FIG. 2, a schematically illustrated switching means is provided which in the switching position, labelled as a, effects a connection between the carbon brushes 21, 22 of said contact roller K1 and said current supply 41, 42 of the carbon brush 34 of the contact roller K4.

In the switching position b of the switching means, the carbon brush is connected to the current rail 50 which is connected to the minus pole 51 via the cable 47.

The plus pole 52 is connected to the contact roller K2 by means of the carbon brushes provided there via a current rail 53 and current supplies 54 and 55.

The deviating roller 60 which is longitudinally movable in a guiding means 61 serves for stretching the belt 20 using a thread 62.

The function of this device is as follows.

By operating the switch 45, the device may be switched from two-path operation to three-path operation. In two-path operation, the contact roller K1 is directly connected to the minus pole via the current rail 50 in switching position b. In this case, the potential difference between the roller K1 (minus pole) and the roller K2 (plus pole) effects a current flow in the piece of wire extending from K1 to K2.

Between the contact roller K2 (plus pole) and the contact roller K3 (minus pole), a potential difference builds up which effects a current flow through this piece of wire. Since the piece of wire extending from K2 to K3 is considerably shorter than the piece of wire extending from K1 to K2, the current flow between K2 and K3 is considerably higher than the current flow between K2 and K1. This effects that in this range a very strong annealing takes place, while the annealing between the range K1 and K2 is smaller and merely constitutes a pre-annealing.

Figure 3:
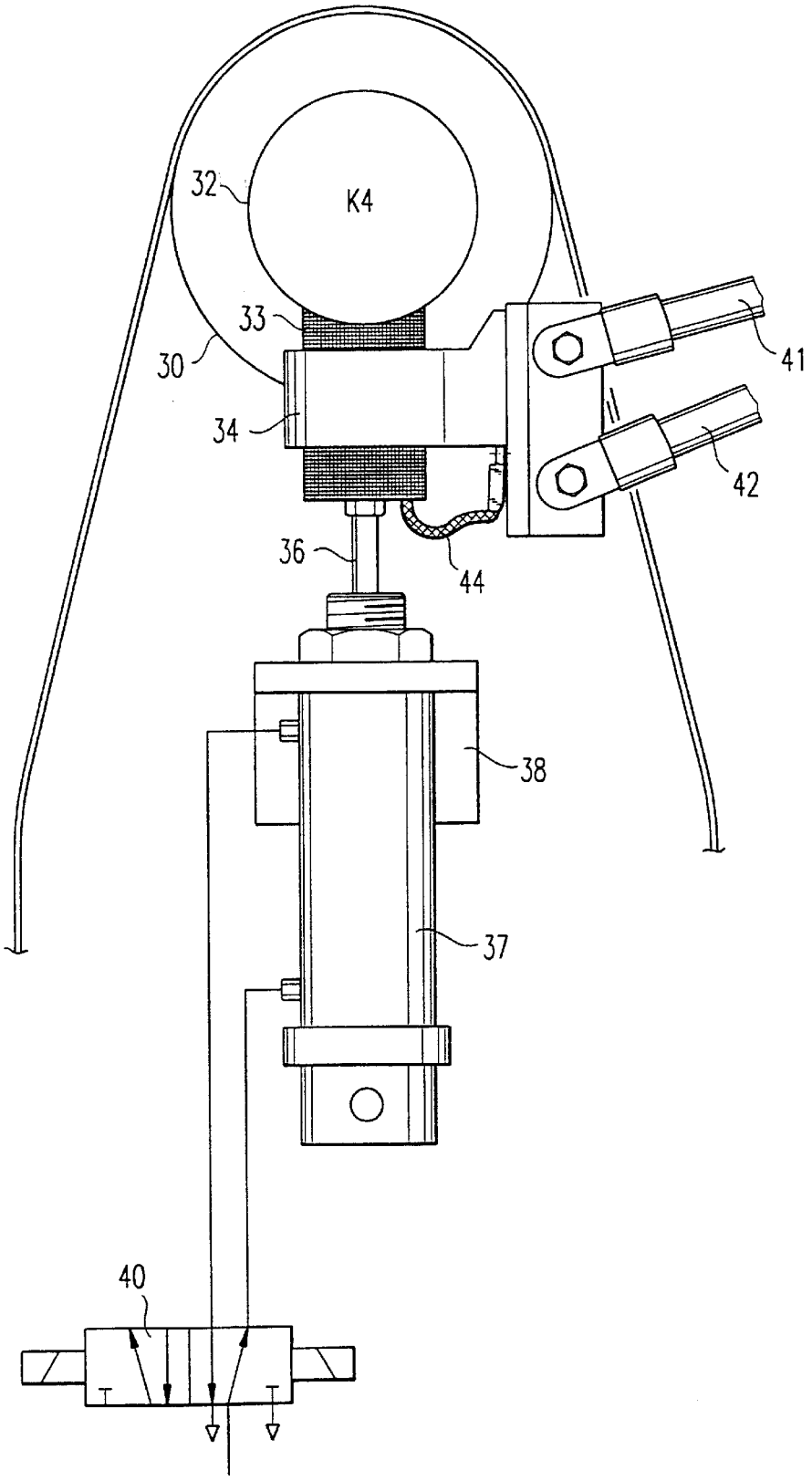
FIG. 3 shows a view of a switching means for effecting a switching connection between a current source and a contact roller.

FIG. 3 shows a diagram having rectangular coordinates wherein on the ordinate the wire passing velocity or production velocity in m/s and on the abscissa the wire diameter in mm are depicted. The hatched area labelled with two-path system is the range of the diameter/velocity ratio wherein the two-path system is optimal regarding energy considerations. This means that the total input power in form of the pre-annealing path K1–K2 and the main annealing path K2–K3 suffices for drying the wire after cooling by the water cooling means 12. For smaller wire diameters or higher production velocities, this measure does not suffice. If the combination of wire diameter and production velocity lies in the area labelled as three-path system, it makes sense to add the third path.

In this embodiment of the invention, this on one hand is effected by switching over the switch 45 and by applying the carbon brush 33 by means of the piston-cylinder means 37 to the contact roller K4. By switching over the switch 45, the contact roller K2 is separated from the minus pole and is electrically connected to the contact roller K4. Thus a circuit is provided, the replacement circuit diagram of which is depicted in FIG. 5.

The switching position of the switch 45 in position b characterizes the above-mentioned two-path operation. In this case, the main annealing path provides the resistance H, while the pre-annealing path provides the electrical resistance V.

Figure 5:
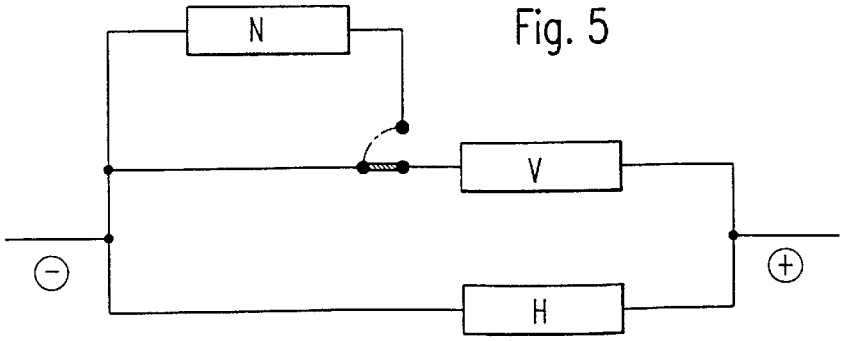
FIG. 5 shows the replacement circuit diagram of the embodiment according to FIG. 1 and 2.

After switching over, the current flows in the defined current direction from the plus pole via the pre-annealing path K1–K2 and via the after-annealing path K3–K4 symbolized by the resistance N in the replacement circuit diagram of FIG. 5.

By addition of the after-annealing path, an additional resistance is provided, as may be seen from the replacement circuit diagram, such that the voltage drop within the pre-annealing path and simultaneously the power supply in the pre-annealing path decreases. Since the final temperature in the pre-annealing path, however, usually does not determine the final temperature in the main annealing path, this temperature decrease in the pre-annealing path may usually be tolerated without further compensation. If in certain operation states the final temperature reached in the main annealing path is no longer sufficient because of the temperature decrease in the pre-annealing path, this can be compensated by correspondingly enhancing the total energy supplied.

In the conventional regulating means for such annealing devices, this can be accounted for by enhancing the so-called annealing factor (see the description in the above-mentioned patent disclosure DE 40 10 309 C1 incorporated herein by reference).

Figure 4:
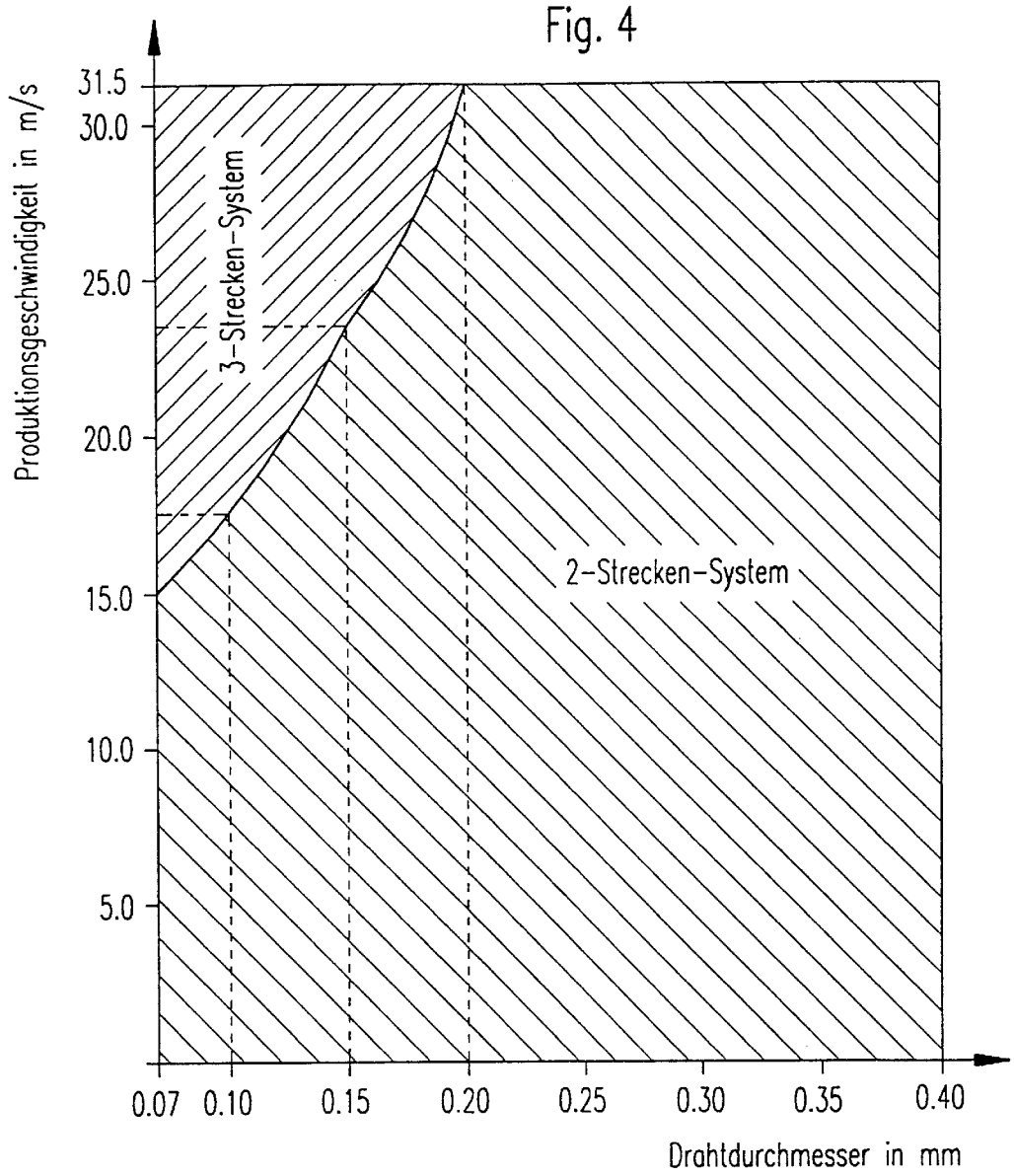
FIG. 4 shows a diagram illustrating the relation between the production velocity, the wire diameter and the optimal switching position according to the present invention.

The advantages of this system will become readily apparent from FIG. 4.

On wire drawers of today normally different drawing programs are run, which means that wires having different final diameters may be produced. The conventional three-path annealing device is, as may be seen from the diagram of FIG. 4, only required in a relatively small velocity diameter range. When the respective operation point of the wire drawer is in the area of the two-path system, the device according to the invention may be switched into the two-path operation so as to provide considerable energy savings.

In comparison to apparatus working only in form of a two-path system, the considerable advantage is provided that also diameter and velocity variants which are usually not possible in two-path operation may be applied in such an apparatus according to the present invention.

What is claimed:

1. A device for continuously heat-treating continuously formed metallic goods, said device comprising:

a first annealing path in which the continuously formed metallic goods are guided by means of two contact rollers, said first contact roller (K1) being arranged at a first end of said first annealing path and said second contact roller being arranged at a second end of said first annealing path, and said first and second contact rollers being connected to a voltage source such that between said first and second contact rollers a current flows through said continuously formed metallic goods;

a second annealing path, in which said continuously formed metallic goods are guided by means of two contact rollers, said third contact roller being arranged at a first end of said second annealing path and said fourth contact roller being arranged at a second end of said second annealing path, and said third and fourth contact rollers being connected to a voltage source such that an electric current flows in said continuously formed metallic goods between said third and fourth contact rollers;

characterized in that, a third annealing path is provided in which said continuously formed metallic goods are guided by means of two contact rollers, a fifth contact roller being arranged at a first end of said third annealing path and a sixth contact roller being arranged at a second end of said third annealing path, and that a switching means is further provided for connecting said fifth and sixth contact rollers to a voltage source such that a current flows through said third annealing path, when said switching means is in a first switching position, and such that no current flows through this third annealing path, when said switching means is in a second switching position.

2. A device according to claim 1, wherein the function of said second contact roller at the end of said first annealing path and the function of said third contact roller at the beginning of said second annealing path are integrated in the function of a single contact roller (K2).

3. A device according to claim 1, wherein the function of said fourth contact roller at the end of said second annealing path and the function of said fifth contact roller are integrated in the function of a single contact roller (K3).

4. A device according to claim 1, wherein said first annealing path is a pre-annealing path, said second annealing path is a main annealing path, and said third annealing path is an after-annealing path.

5. A device according to claim 1, wherein said first annealing path and said third annealing path are electrically connected in series, when said switching means is in said first position.

6. A device according to claim 4, wherein between said first contact roller (K1) and said second and third contact rollers (K2), respectively, said pre-annealing path is formed, such that between said second and third contact rollers (K2), respectively, and said fourth and fifth contact rollers (K3), respectively, said main annealing path is formed, and such that between said fourth and fifth contact rollers (K3), respectively, and said sixth contact roller (K4) said after-annealing path is formed.

7. A device according to claim 6, wherein in the switching position wherein no current flows through said third annealing path, said first roller (K1) is connected to a first potential point (minus or plus pole) of said voltage supply, said second and third contact rollers (K2), respectively, is connected with a second potential point of said voltage source (plus or minus pole), and said fourth and fifth contact roller (K3), respectively, is again connected to said first potential point (minus or plus pole).

8. A device according to claim 7, wherein, when switching said switching means into said first switching position wherein no current flows through said third annealing path, the connection between said first contact roller (K1) to said first potential point is interrupted and an electrical connection between said first contact roller (K1) and said sixth contact roller (K4) is effected.

9. A device according to claim 4, wherein following said main annealing path, a water cooling means (12) is provided.

10. A device according to claim 4, wherein said main annealing path is arranged such that said continuously formed metallic goods are essentially surrounded by an inert gas or by water steam.

11. A device according to claim 4, wherein a switchable carbon brush (33) is provided which is connected with said sixth contact roller (K4) such that an electrical contact between said carbon brush (33) and said sixth contact roller (K4) is effected.

12. A device according to claim 11, wherein said carbon brush (33) is connected to a piston-cylinder means (37) controlled by a solenoid valve (40) and arranged to bring the carbon brush into or out of contact with a sliding ring which is concentrically arranged with respect to said sixth contact roller (K4) and electrically connected therewith.

13. A device according to claim 1, wherein a belt driving means is provided for synchronously driving said contact rollers.

14. A device according to claim 1, wherein said continuously formed metallic goods are wire.

* * * * *

UNITED STATES PATENT AND TRADEMARK OFFICE

CERTIFICATE OF CORRECTION

PATENT NO. : 5,885,523

DATED : March 23, 1999

INVENTOR(S) : Bernt Lohmuller, et al.

It is certified that error appears in the above-identified patent and that said Letters Patent is hereby corrected as shown below:

Column 4, line 53, "The hatched..." should begin a new paragraph starting on line 54.

Title page: Item [56] , under [56] References Cited, U.S. Patent Documents, line 2, "4,116,433" should be --4,116,422--.

Signed and Sealed this

Seventeenth Day of August, 1999

*Attest:*

Q. TODD DICKINSON

*Attesting Officer*

*Acting Commissioner of Patents and Trademarks*